US006379221B1

(12) United States Patent
Kennedy et al.

(10) Patent No.: US 6,379,221 B1
(45) **Date of Patent: *Apr. 30, 2002**

(54) METHOD AND APPARATUS FOR AUTOMATICALLY CHANGING A POLISHING PAD IN A CHEMICAL MECHANICAL POLISHING SYSTEM

(75) Inventors: Daniel F. Kennedy, San Jose; Victor Belitsky, Sunnyvale; Arul Shanmugasundram, Mountain View, all of CA (US)

(73) Assignee: Applied Materials, Inc., Santa Clara, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/777,906

(22) Filed: Dec. 31, 1996

(51) Int. Cl.[7] ..... B24B 1/00

(52) U.S. Cl. ..... 451/41; 451/59; 451/289; 451/456; 414/226.02; 901/16; 901/40

(58) Field of Search ..... 451/41, 59, 287, 451/289, 456; 414/225.01, 226.02, 226.05; 901/6, 7, 15, 16, 40

(56) References Cited

U.S. PATENT DOCUMENTS

| | | | | |
|---|---|---|---|---|
| 4,527,358 A | | 7/1985 | Day | 51/131.3 |
| 4,680,893 A | | 7/1987 | Cronkhite et al. | 51/154 |
| 5,065,547 A | | 11/1991 | Shimizu et al. | 51/154 |
| 5,065,548 A | | 11/1991 | Shimizu et al. | 51/154 |
| 5,152,917 A | | 10/1992 | Pieper et al. | 51/295 |
| 5,154,021 A | | 10/1992 | Bombardier et al. | 51/262 |
| 5,167,667 A | | 12/1992 | Prigge et al. | 8/137 |
| 5,224,304 A | | 7/1993 | Cesna | 51/281 |
| 5,232,875 A | | 8/1993 | Tuttle et al. | 437/225 |
| 5,234,867 A | | 8/1993 | Schultz et al. | 437/225 |
| 5,246,525 A | | 9/1993 | Sato | 156/345 |
| 5,257,478 A | | 11/1993 | Hyde et al. | 51/131 |
| 5,333,413 A | | 8/1994 | Hashimoto | 51/165 |
| 5,342,419 A | | 8/1994 | Hibbard | 51/308 |
| 5,378,251 A | | 1/1995 | Culler et al. | 51/295 |
| 5,456,627 A | | 10/1995 | Jackson et al. | 451/11 |
| 5,482,496 A | | 1/1996 | Lanzer | 451/5 |
| 5,660,581 A | * | 8/1997 | Shin et al. | 451/285 |
| 5,676,590 A | * | 10/1997 | Hiraoka | 451/289 |
| 5,704,827 A | | 1/1998 | Nishi et al. | |

FOREIGN PATENT DOCUMENTS

| | | |
|---|---|---|
| DE | 3319328 | 12/1983 |
| EP | 0756917 | 2/1997 |
| EP | 0818272 | 1/1998 |
| JP | 4083328 | 3/1992 |

* cited by examiner

*Primary Examiner*—Eileen P. Morgan
(74) *Attorney, Agent, or Firm*—Fish & Richardson

(57) ABSTRACT

A method and an apparatus for automatically replacing a used polishing pad in a chemical mechanical polishing system are described. A controller places a mechanical device against the used polishing pad while the pad is on the polishing platen and activates a pad chucking mechanism that affixes the used pad to the mechanical device. The controller then moves the mechanical device and the pad toward a used pad receptacle, where the pad chucking mechanism is deactivated to release the used pad into the receptacle. The controller then places the mechanical device against a clean polishing pad in a clean pad dispenser and reactivates the pad chucking mechanism to affix the clean pad to the mechanical device. The mechanical device and the clean pad are moved toward the platen, where the pad chucking mechanism is deactivated to release the clean polishing pad onto the platen.

12 Claims, 15 Drawing Sheets

METHOD AND APPARATUS FOR AUTOMATICALLY CHANGING A POLISHING PAD IN A CHEMICAL MECHANICAL POLISHING SYSTEM

BACKGROUND OF THE INVENTION

The present invention relates generally to chemical mechanical polishing of substrates, and more particularly to a method and apparatus for automatically changing a polishing pad in a chemical mechanical polishing system.

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes increasingly more non-planar. This non-planar outer surface presents a problem for the integrated circuit manufacturer. If the outer surface of the substrate is non-planar, then a photoresist layer placed thereon is also non-planar. A photoresist layer is typically patterned by a photolithographic apparatus that focuses a light image onto the photoresist. If the outer surface is sufficiently non-planar, then the maximum height difference between the peaks and valleys of the outer surface may exceed the depth of focus of the imaging apparatus. It will then be impossible to properly focus the light image onto the entire outer surface.

It may be prohibitively expensive to design new photolithographic devices having an improved depth of focus. In addition, as the feature size used in integrated circuits becomes smaller, shorter wavelengths of light must be used, resulting in further reduction of the available depth of focus. Therefore, there is a need to periodically planarize the substrate surface to provide a planar surface.

Chemical mechanical polishing is one accepted method of planarization. This planarization method typically requires that the substrate be mounted on a carrier head or polishing head. The exposed surface of the substrate is then placed against a rotating polishing pad. The carrier provides a controllable load, i.e., pressure, on the substrate to push it against the polishing pad. In addition, the carrier may rotate to provide additional motion between the substrate and polishing surface. A polishing slurry, including an abrasive and at least one chemically-reactive agent, is supplied to the polishing pad to provide an abrasive chemical solution at the interface between the pad and substrate.

Chemical mechanical polishing is a fairly complex process, and it differs from simple wet sanding. In a chemical mechanical polishing process, a reactive agent in the slurry reacts with the outer surface of the substrate to form reactive sites. The interaction of the polishing pad and abrasive particles at the reactive sites on the substrate results in polishing.

Polishing pads used in a chemical mechanical polishing process must be replaced periodically to insure efficient polishing of substrates. In general, pad replacement requires a person to remove a used pad from a platen, to remove excess adhesive remaining on the platen, to place fresh adhesive over the surface of the platen, and to affix a clean polishing pad to the platen.

An additional consideration in the production of integrated circuits is process and product stability. To achieve a high yield, i.e., a low defect rate, each successive substrate should be polished under substantially similar conditions. Each substrate, in other words, should be polished approximately the same amount so that each integrated circuit is substantially identical.

SUMMARY OF THE INVENTION

In one aspect, the invention features a method and an apparatus for automatically removing a used polishing pad from a chemical mechanical polishing (CMP) system. A mechanical device is placed against the used polishing pad on a platen in the CMP system, and the pad is chucked to the mechanical device. The mechanical device and the pad are moved toward a used pad receptacle, into which the pad is released from the mechanical device.

Embodiments of the invention may include the following features. A lifting mechanism, such as a pneumatic actuator, may be used to lift the used polishing pad from the platen. A vacuum pump may be used to chuck the pad to the platen.

In another aspect the invention features a method and an apparatus for automatically placing a polishing pad on a polishing platen in a CMP system. A mechanical device is placed against the polishing pad in a pad dispenser, and the pad is chucked to the mechanical device. The mechanical device and the pad then are moved toward the polishing platen, and the pad is released from the mechanical device onto the platen.

Embodiments of the invention may include the following features. The polishing pad may be chucked to the platen. A vacuum pump may be used to chuck the pad to the mechanical device or to the platen. The platen may be aligned at a predetermined orientation as the polishing pad is placed onto the platen.

In another aspect, the invention features a CMP apparatus having a platen adapted to hold the polishing pad, a mechanical device operable to remove the polishing pad from the platen automatically, and a pad receptacle positioned to receive the polishing pad from the mechanical device after the pad is removed from the platen.

In yet another aspect, the invention features a CMP apparatus having a platen adapted to hold the polishing pad, a pad dispenser adapted to house the polishing pad temporarily, and a mechanical device operable to retrieve the polishing pad from the pad dispenser and place the polishing pad onto the platen automatically.

Embodiments of the invention may include the following features. The platen may include a pad chucking mechanism that affixes the polishing pad to the platen. The mechanical device may include a pad chucking mechanism that affixes the polishing pad to the mechanical device. Each of the pad chucking mechanisms may include a vacuum pump. The CMP apparatus also may include a platen alignment mechanism that holds the platen at a predetermined orientation, and a pad alignment mechanism that positions the polishing pad at a predetermined orientation before it is placed onto the platen. A controller may be used to govern the operation of the mechanical device.

In another aspect, the invention features a method and an apparatus for replacing a used polishing pad in a chemical mechanical polishing system. A mechanical device is placed against the used polishing pad while the pad is on a polishing platen, and the pad is chucked to the mechanical device. The mechanical device and the pad then are moved toward a used pad receptacle, into which the pad is released from the mechanical device. The mechanical device then is placed against a clean polishing pad in a clean pad dispenser, and the clean pad is chucked to the mechanical device. The mechanical device and a clean pad then are moved toward the platen, onto which the clean pad is released from the mechanical device.

Advantages of the invention may include one or more of the following. Manual labor may be eliminated from routine replacement of polishing pads. Throughput and efficiency of a chemical mechanical polishing system may be improved, and accidental damage to clean polishing pads during pad replacement may be minimized or even eliminated. Critical alignment between the polishing pad and platen may be controlled automatically.

Other features and advantages of the invention will be set forth in the description which follows, and in part will be obvious from the description, or may be learned by practice of the invention. The advantages of the invention may be realized by means of the instrumentalities and combinations particularly pointed out in the claims.

BRIEF DESCRIPTION OF THE DRAWINGS

The accompanying drawings, which are incorporated in and constitute a part of the specification, schematically illustrate embodiments of the invention, and together with the general description given above and the detailed description of the embodiments given below, serve to explain the principles of the invention.

DESCRIPTION OF THE PREFERRED EMBODIMENTS

Figure 1:
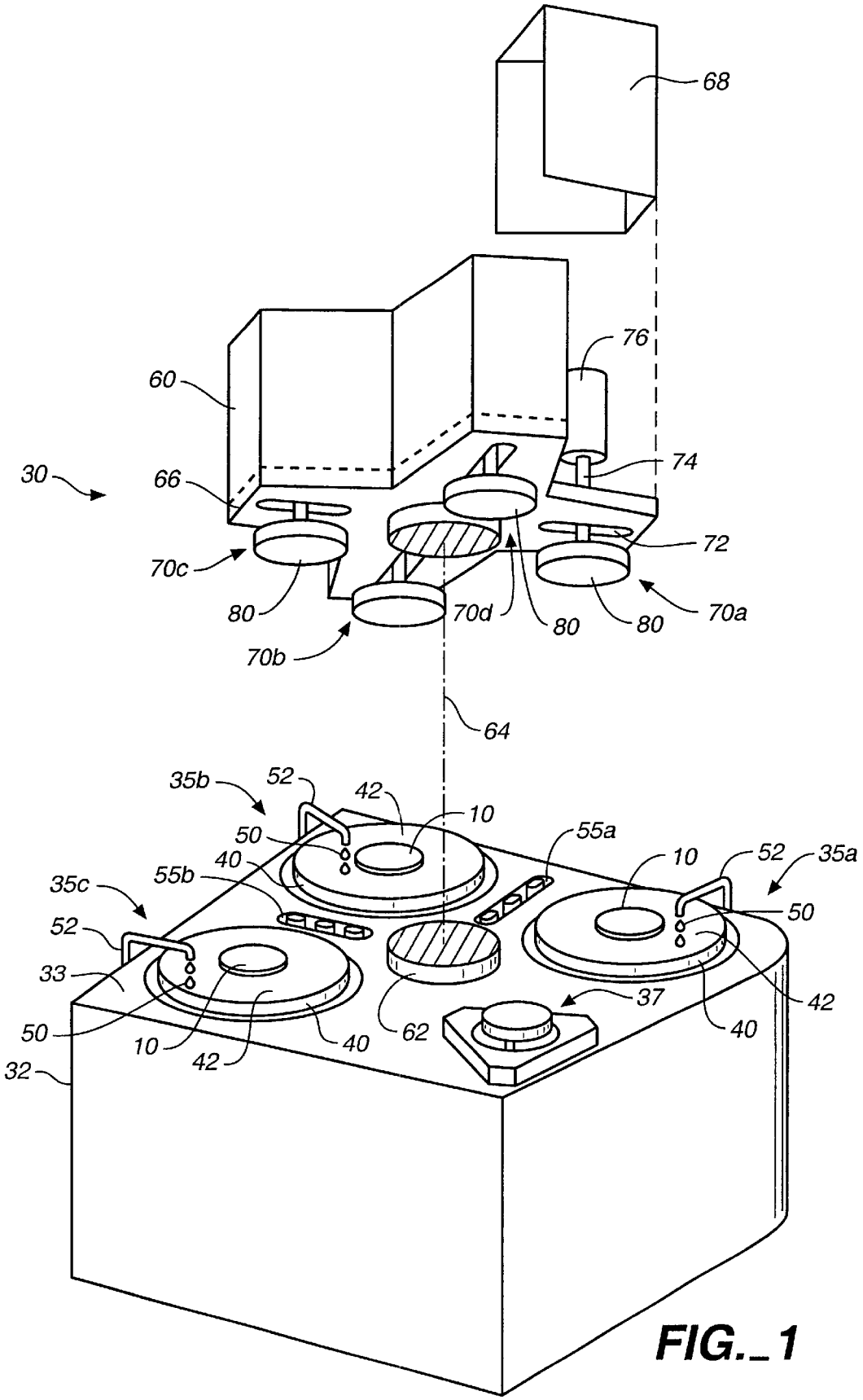
FIG. 1 is a schematic exploded perspective view of a chemical mechanical polishing apparatus.

Referring to FIG. 1, a chemical mechanical polishing (CMP) apparatus 30 in which the present invention may be implemented is shown. The CMP apparatus 30 includes a lower machine base 32 with a table top 33 mounted thereon and a removable upper outer cover (not shown). Table top 33 supports a series of polishing stations 35*a*, 35*b* and 35*c*, and a transfer station 37. Transfer station 37 forms a generally square arrangement with polishing stations 35*a*, 35*b* and 35*c*. Transfer station 37 serves multiple functions, including receiving individual substrates 10 from a loading apparatus (not shown), washing the substrates, loading the substrates into carrier or polishing heads 80 (described below), receiving the substrates from the carriers, washing the substrates again, and finally transferring the substrates back to the loading apparatus. Additional details of the CMP apparatus 30 may be found in U.S. application Ser. No. 08/549,336, filed Oct. 27, 1995, entitled "CAROUSEL PROCESSING SYSTEM FOR CHEMICAL MECHANICAL POLISHING" and assigned to Applied Materials, Inc., which is incorporated by reference.

Each polishing station 35*a*–35*c* includes a rotatable platen 40 having a polishing pad 42. A slurry 50 containing a reactive agent (e.g., deionized water for oxide polishing), abrasive particles (e.g., silicon dioxide for oxide polishing) and a chemically-reactive catalyzer (e.g., potassium hydroxide for oxide polishing) is supplied to the surface of polishing pad 42 by a slurry supply tube 52. Sufficient slurry is provided to cover and wet the entire polishing pad 42. Two or more intermediate washing stations 55*a* and 55*b* may be positioned between neighboring polishing stations 35*a*, 35*b* and 35*c*. The washing stations rinse the substrates as they pass from one polishing station to another.

A rotatable multi-head carousel 60 is positioned above lower machine base 32. Carousel 60 is supported by a center post 62 and rotated thereon about a carousel axis 64 by a carousel motor assembly (not shown) located within base 32. Center post 62 supports a carousel support plate 66 and a cover 68. Multi-head carousel 60 includes four carrier head systems 70*a*, 70*b*, 70*c*, and 70*d*. Three of the carrier head systems receive and hold substrates and polish them by pressing them against polishing pads 42 on platens 40 of polishing stations 35*a*–35*c*. One of the carrier head systems receives a substrate from and delivers the substrate to transfer station 37.

The four carrier head systems 70*a*–70*d* are mounted on carousel support plate 66 at equal angular intervals about carousel axis 64. Center post 62 allows the carousel motor to rotate the carousel support plate 66 and to orbit the carrier head systems 70*a*–70*d*, and the attached substrates, about carousel axis 64.

Each carrier head system 70*a*–70*d* includes a carrier or carrier head 80. Each carrier head 80 independently rotates about its own axis and independently laterally oscillates in a radial slot 72 formed in carousel support plate 66. A carrier drive shaft 74 connects a carrier head rotation motor 76 to carrier head 80 (shown by the removal of one-quarter of cover 68). There is one carrier drive shaft and motor for each head.

Figure 2:
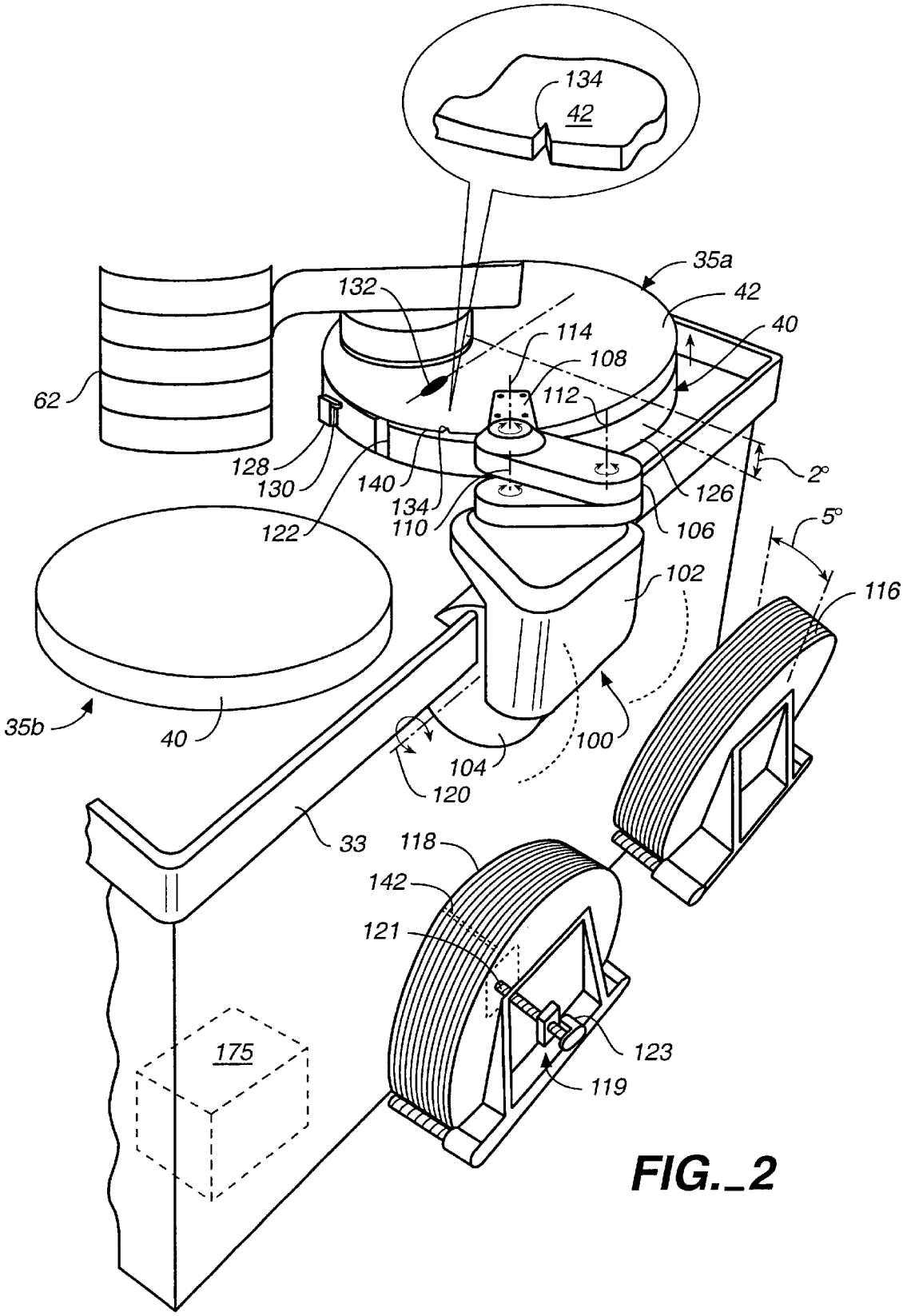
FIGS. 2 and 3 are partial perspective views of a chemical mechanical polishing apparatus with an automatic pad changing mechanism.

Referring to FIG. 2, an automatic pad exchanging mechanism 100 is mounted to the table top 33 of the chemical mechanical polishing apparatus. The pad exchanging mechanism 100 is a robot that replaces polishing pads 42 on the platens 40 at polishing stations 35*a* and 35*b*. The pad exchanging mechanism 100 places used pads in a receptacle 116 mounted to the polishing apparatus and retrieves clean pads from a dispenser 118 also mounted to the polishing apparatus. The used pad receptacle 116 and the clean pad dispenser 118 preferably are indexing cassettes, as described below. Alternatively, the "dispenser" and "receptacle" may simply be stacks of new pads and used pads, respectively. An additional pad exchanging mechanism, used pad receptacle, and clean pad dispenser are similarly mounted to the CMP apparatus between polishing stations 35*b* and 35*c* (FIG. 1).

Figure 3:
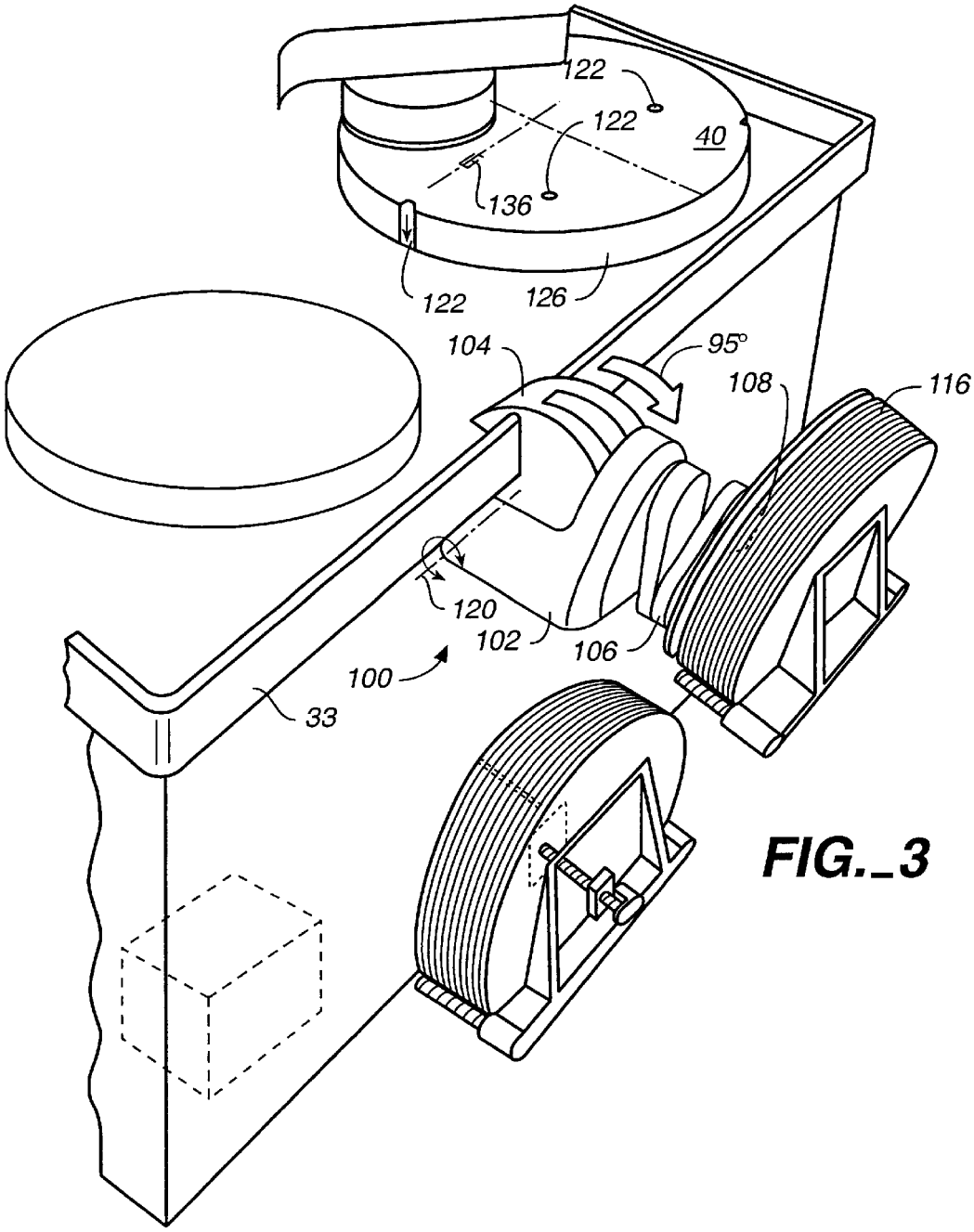

The pad exchanging mechanism 100 consists of a movable planar manipulator 102 mounted onto a fixed base 104. The planar manipulator 102 includes a movable arm 106 and an end effector 108 that acts as a pad chucking mechanism. The end effector 108 is a standard Venturi blade that uses suction generated by a vacuum pump to chuck the polishing pad 42, as described below. The movable arm 106 pivots about three axes 110, 112, and 114 to remove and replace polishing pads at polishing stations 35*a* and 35*b*. Referring also to FIG. 3, the planar manipulator 102 as a whole rotates about the fixed base 104 along horizontal axis 120 to access the used pad receptacle 116 and the new pad dispenser 118. Planar manipulator robots are made by several companies, including Rorze Corporation. One such planar manipulator robot is shown in Rorze documents 1VRR8140-008-101 and 1VRR8151.

Within the used pad receptacle 116 and the clean pad dispenser 118, the new and used pads are tilted to an angle of 5° away from the polishing apparatus to allow gravity to hold the pads in place. As a result, the planar manipulator 102 must rotate a total of 95° around the horizontal axis 120 to retrieve clean pads from the new pad dispenser 118 and to place used pads into the used pad receptacle 116. The clean pad dispenser 118 also includes an indexing mechanism 119 that moves the stack of pads in the dispenser forward by the thickness of one pad (generally ¼ inch) when a pad is removed from the dispenser 118. The indexing mechanism 119 preferably includes a leadscrew and linear drive assembly 121 driven by an encoder equipped motor 123. A similar indexing mechanism may be included in the used pad receptacle 116 to allow the used pads to move away from the CMP apparatus each time a pad is placed in the receptacle. The position of the indexing mechanism 119 is governed by a controller 175, as described below.

To prevent slurry on the used pads from contaminating the end effector 108, one or more pad lifting mechanisms 122 are built into the outer surface 126 of each platen 40. The lifting mechanisms 122 slightly elevate the used polishing pad 42 and allow the end effector 108 to contact the bottom surface of the pad 42. The lifting mechanisms 122 should lift the pad 42 enough to allow the end effector 108 to move freely under the pad 42, but should not lift the pad 42 so high that it contacts the carrier head 80. In a standard CMP apparatus, the lifting mechanisms 122 may lift a 20-inch pad 42 to a 2° tilt without causing the pad 42 to contact the carrier head 80 and still allow the end effector 108 to move freely under the pad 42. As shown in FIG. 3, the lifting mechanisms 122 may be built into the body of each platen 40 instead of or in addition to the outer surface 126. The construction and operation of the lifting mechanisms are described below.

The lifting mechanisms 122 may be eliminated altogether if the end effector 108 is a double-sided blade. In this situation, the planar manipulator 102 removes a used pad by applying suction to the top surface of the pad and lifting the pad away from the platen 40. The planar manipulator 102 places a new pad on the platen by applying suction to the pad's lower surface and laying the pad on the platen. Because the pads are flexible, the new pad can be held to the platen 40 by activating the platen's pad chucking mechanism before or as soon as the pad makes contact with the platen 40.

Some chemical mechanical polishing systems include an endpoint detector alignment feature, such as described in U.S. patent application Ser. No. 08/605,769, filed Feb. 22, 1996, entitled "APPARATUS AND METHOD FOR INSITU ENDPOINT DETECTION FOR CHEMICAL MECHANICAL POLISHING" and assigned to Applied Materials, Inc., which is incorporated by reference. In these systems, the pad exchanging mechanism 100 must align an opening 136 (FIG. 3) in each platen 40 with a transparent "window" 132 (FIG. 2) in each polishing pad 42 to allow operation of the endpoint detection system in the platen. To insure that the platens 40 and the pads 42 are aligned, each platen 40 includes a homing flag 130 that is detected by a homing sensor 128 mounted to the table top 33. When the homing sensor 128 detects the homing flag 130, the homing sensor 128 sends a signal to the controller 175 that instructs the controller 175 to stop the rotation of the platen 40, as described below. Each polishing pad 42 includes a notch or groove 134 on its outer edge 140 that fits around a corresponding ridge 142 in the new pad dispenser 118 to properly align the pads in the dispenser.

Figure 4:
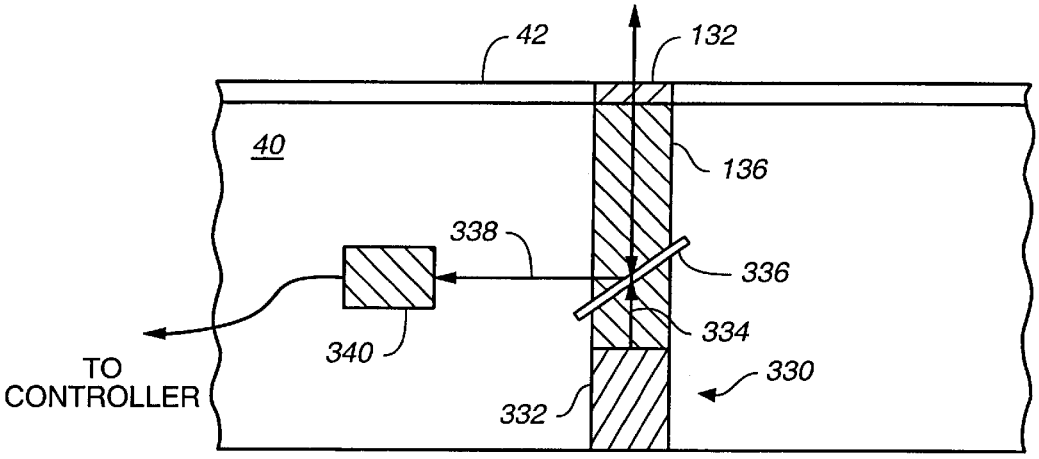
FIG. 4 is a partial cross-sectional view of a platen having an endpoint detection system also used as a platen homing device.

Referring to FIG. 4, the endpoint detection system 330 in the platen 40 may be used instead of the homing sensor and flag to align the platen 40 and the pad 42. The endpoint detection system 330 includes a laser source 332 that projects a laser beam 334 directly upward through the opening 136 in the platen 40. The laser beam passes through a 45° beam splitter 336 and encounters the pad 42 when the pad 42 is on the platen 40. Whether light is transmitted through the pad 42 or reflected back into the platen 40 depends upon the orientation of the pad 42.

When the pad 42 is properly aligned, most of the light in the laser beam 334 passes through the transparent window 132, but some of the light reflects from the window 132 back into the platen 40. When the pad 42 is above the platen 40 but is not yet properly aligned, most of the light in the laser beam reflects back into the platen 40.

The beam splitter 336 redirects the portion 338 of the laser beam 334 that is reflected back into the platen 40 toward a receiver 340. The receiver 340 is an intensity threshold detector that determines whether the reflected light 338 has relatively high, relatively low, or no intensity. When the reflected light 338 has relatively low intensity, the pad 42 is properly aligned and the receiver 340 generates a signal that instructs the controller to halt the rotation of the platen 40. Otherwise, the receiver 340 sends no signal.

All motors and pumps used in the automatic pad exchange system are controlled by the control system 175. The controller system 175 may be a single control unit, or it may comprise multiple control units. Preferably, the control system 175 includes a programmable controller, such as a microprocessor running a program code. The operation of the control system 175 during the pad changing process is described below.

Figure 5A:
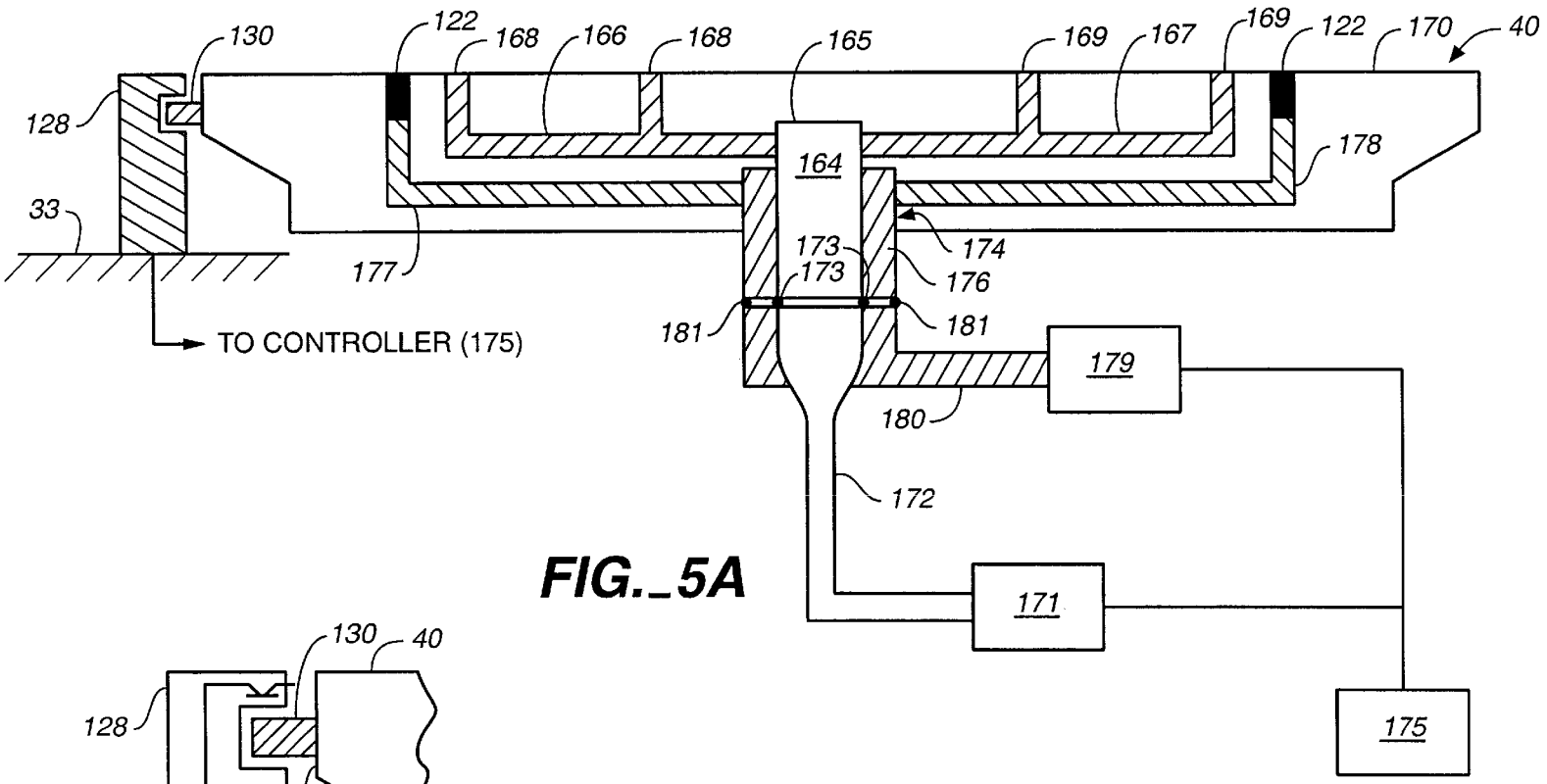
FIG. 5A is a cross-sectional view of a platen with pad lifting and homing detection capabilities.
Figure 5B:
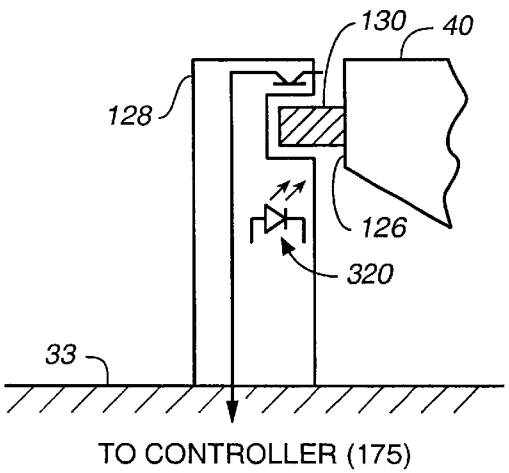
FIG. 5B is a partial cross-sectional view of a platen homing sensor and a platen having a homing flag.
Figure 6A:
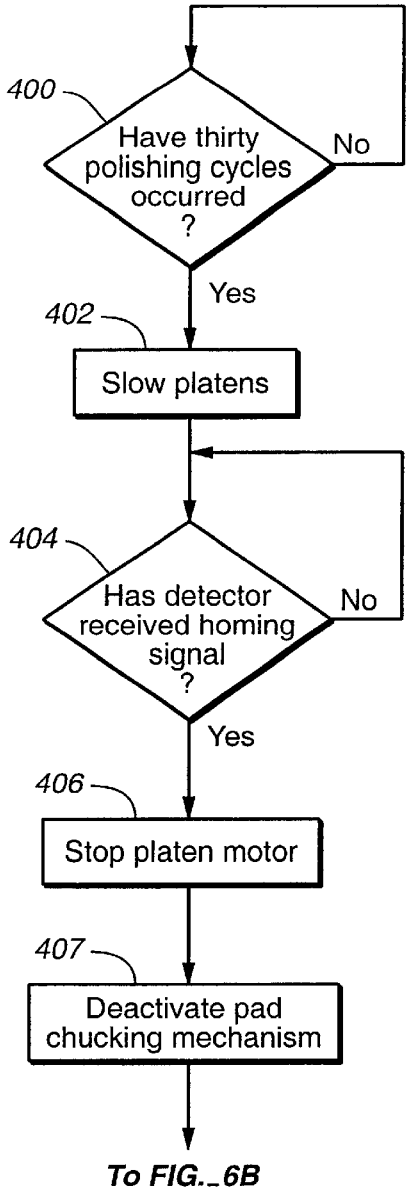
FIGS. 6A through 6G are a flow diagram of a control system for a chemical mechanical polishing apparatus with an automatic pad changing mechanism.
Figure 6B:
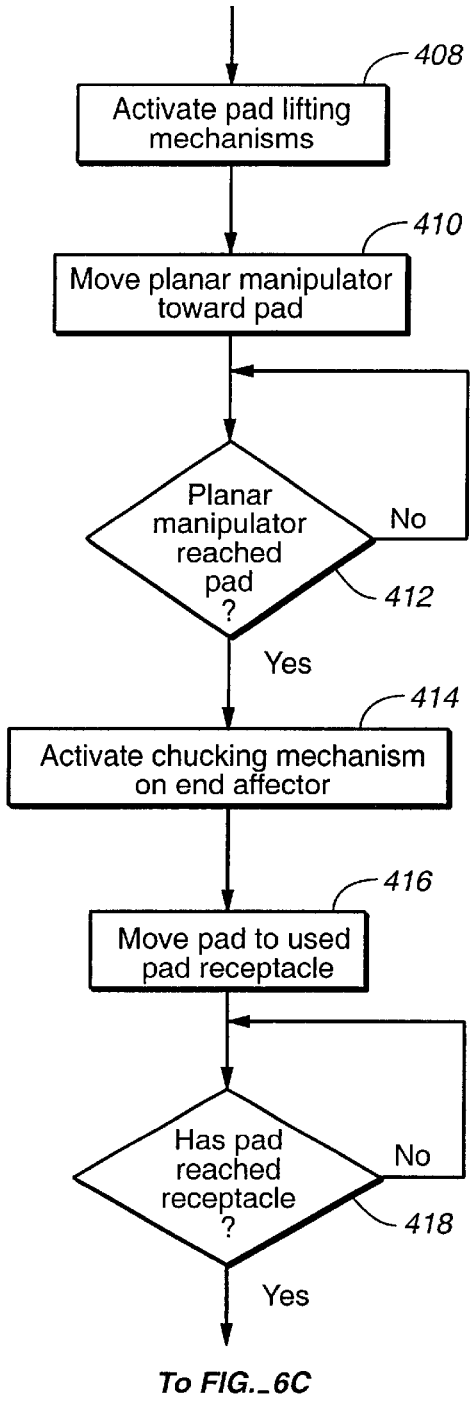
Figure 6C:
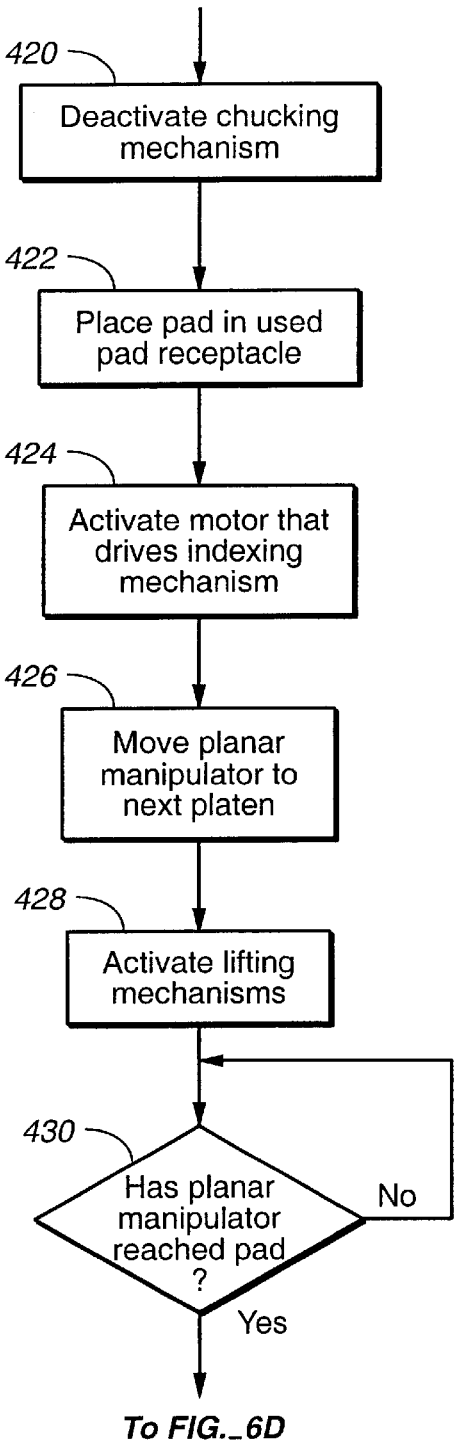
Figure 6D:
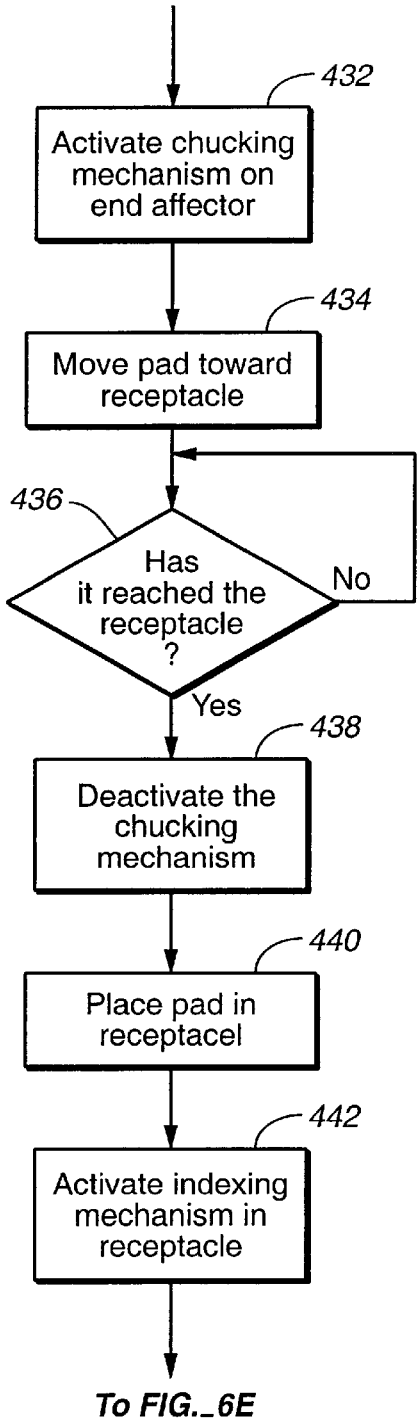
Figure 6E:
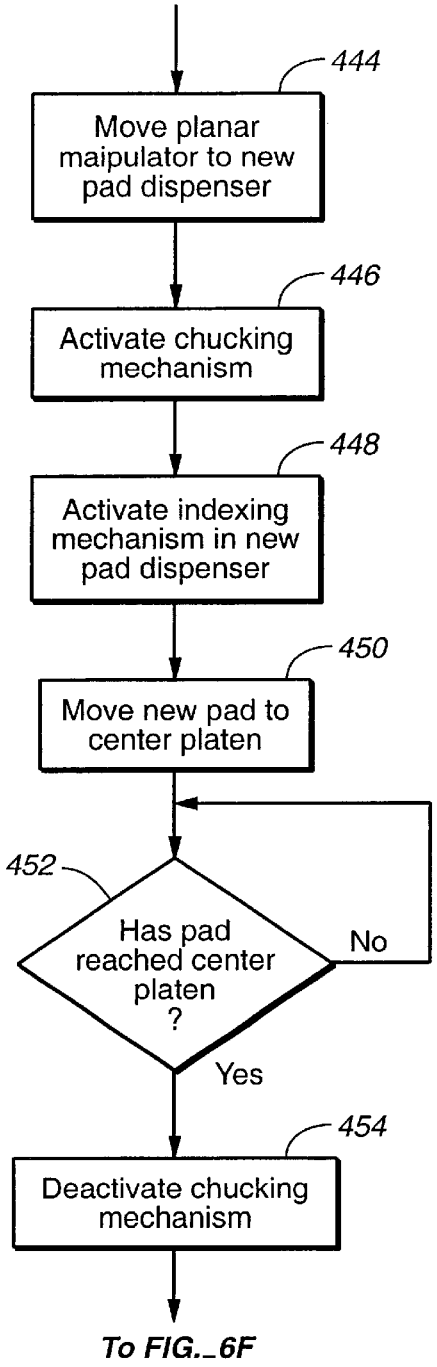
Figure 6F:
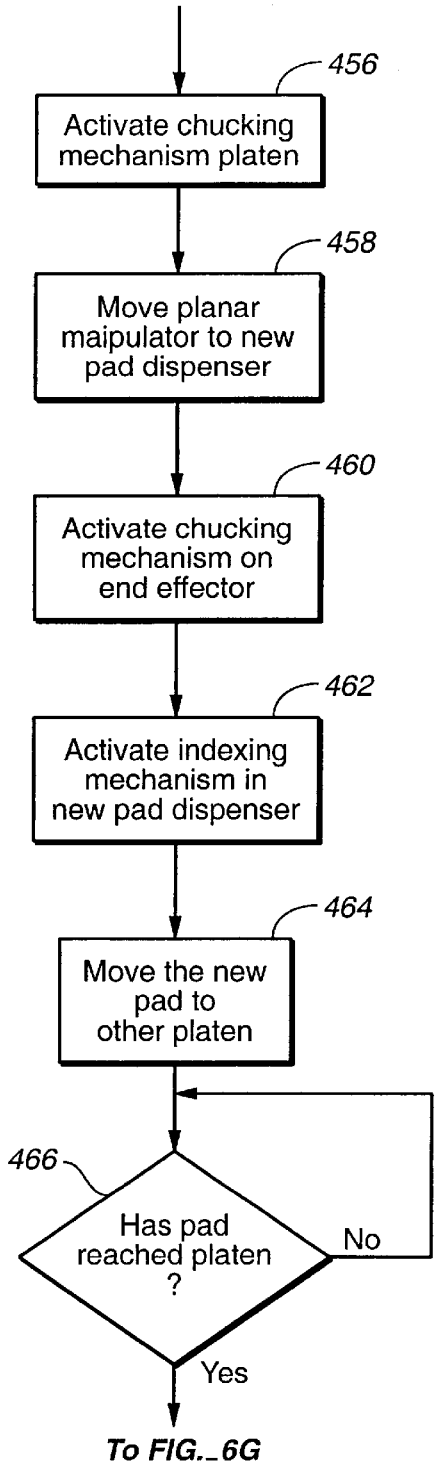
Figure 6G:
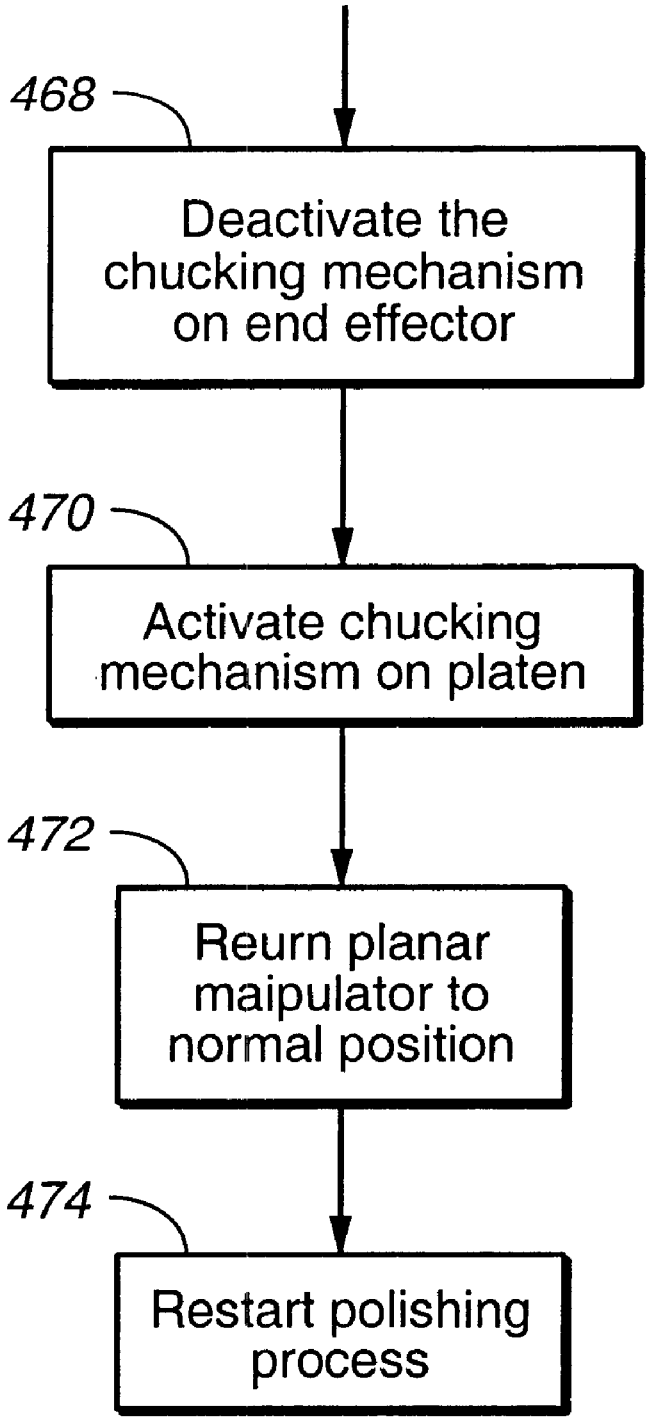

Referring to FIGS. 5A and 5B, each platen 40 includes a vacuum driven pad chucking mechanism 164. The pad chucking mechanism 164 includes a hollow chamber 165 in the platen that opens into passageways 166 and 167, each of which leads to multiple openings 168 and 169 in the top surface 170 of the platen 40. The pad chucking mechanism 164 is coupled to a vacuum device 171, such as an air pump, through a stationary conduit 172. The connection between the stationary conduit 172 and the rotating platen 40 is a standard rotary union coupling sealed by bearings 173. The vacuum device 171 is controlled by controller 175. Vacuum driven pad chucking mechanisms are described in a U.S. patent application entitled "HOLDING A POLISHING PAD ON A PLATEN IN A CHEMICAL MECHANICAL POLISHING SYSTEM," filed on Jul. 12, 1996, with Express Mail Label No. TB888889881US and assigned to Applied Materials, Inc., which is incorporated by reference.

The platen 40 also includes a system 174 that drives the pad lifting mechanisms 122. This system 174 includes a hollow chamber 176 surrounding the hollow chamber 165 of the pad chucking mechanism 164. Passageways 177 and 178 connect the hollow chamber 176 to the lifting mechanisms 122. The lifting mechanisms 122 are activated by a pressure source 179, such as a pneumatic pump, that is coupled to the hollow chamber 176 through a stationary conduit 180. The connection between the hollow chamber 176 and the stationary conduit 180 is a standard rotary union coupling sealed by bearings 181. Like the vacuum source 171, the pressure source 179 is controlled by the controller 175.

Alternatively, both the vacuum source 171 and the pneumatic pressure source 179 could be coupled to one hollow chamber 165 and could apply suction pressure and pneumatic pressure to the openings 168 and 169 and to the pad lifting mechanisms 122, respectively, through the same passageways 166 and 167. In this embodiment, the passageways 166 and 167 would deliver suction pressure to the pad when the vacuum source 171 is activated and would deliver pneumatic pressure to the lifting mechanisms 122 when the pneumatic pressure source 179 is activated.

As noted above, the platen 40 may include a homing signal flag 130, which is a tab that protrudes from the outer surface 126 of the platen 40. The homing sensor 128 mounted to the baseplate 125 of the CMP system's table top 33 detects the homing flag 130 and instructs the controller 175 to stop the rotating platen 40. The homing sensor 128, when activated by the controller, is an optical coupler 320, or "optoisolator," that provides a continuous signal to the controller that is broken only when the homing flag 130 passes through the optoisolator 320. The controller 175 halts the platen's rotation when the signal is broken. Alternatively, the homing sensor 128 may be a capacitive or an inductive device that generates a pulse when the homing flag 120 passes by.

Referring to FIGS. 6A through 6F and again to FIG. 2, the control system 175 monitors the number of polishing cycles that the pads have undergone since the last pad exchange. In a CMP system using fixed abrasive pads and running at an optimal polishing rate of approximately sixty wafers per hour per pad, the pads should be changed once every thirty minutes (after approximately thirty polishing cycles). Conventional non-fixed-abrasive pads that are conditioned periodically will be changed less often that fixed abrasive pads.

The control system 175 continuously watches (step 400) for a predetermined number (e.g., thirty) of polishing cycles to occur. When the predetermined number of polishing cycles have occurred, the control system 175 slows (step 402) the platens and waits (step 404) for a signal from each homing sensor 128. When the control system 175 receives the signal from a homing sensor 128, the control system 175 immediately stops (step 406) the encoder-equipped motor driving the corresponding platen. The control system 175 then deactivates (step 407) the platen's pad chucking mechanism and activates (step 408) the pad lifting mechanisms 122 for the center platen, if pad lifting mechanisms 122 are used in the system. The controller begins moving (step 410) the planar manipulator 102 toward the pad on the center platen and then watches (step 412) for the planar manipulator to reach the pad. When the planar manipulator reaches the pad, the control system 175 activates (step 414) the chucking mechanism on the end effector 108 to secure the pad to the end effector 108. If the system includes pad lifting mechanisms, the controller places the planar manipulator under the pad and activates a chucking mechanism on the upper surface of the end effector. If the system does not include pad lifting mechanisms, the controller places the planar manipulator on the upper surface of the pad and activates a chucking mechanism on the lower surface of the end effector. The control system 175 then moves (step 416) the planar manipulator and the pad toward the used pad receptacle 116. The controller 175 monitors the planar manipulator to determine (step 418) when it reaches the used pad receptacle 116 and, when it does, the controller deactivates (step 420) the chucking mechanism and releases (step 422) the pad into the used pad receptacle 116. At the same time, the control system 175 activates (step 424) the motor that drives the indexing mechanism in the used pad receptacle 116.

Once the used pad has been placed in the receptacle, the control system 175 begins to move (step 426) the planar manipulator toward the platen at polishing station 35*b* and activates (step 428) the lifting mechanisms 122, if any, to lift the corresponding pad. The control system 175 waits (step 430) for the planar manipulator 102 to reach the pad and then activates (step 432) the chucking mechanism on the end effector 108 to secure the pad. The controller then moves (step 434) the pad toward the receptacle 116 and waits (step 436) for the pad to reach the receptacle 116. When the planar manipulator 102 reaches the receptacle 116, the control system 175 deactivates (step 438) the chucking mechanism, places (step 440) the pad in the receptacle 116, and activates (step 442) the indexing mechanism in the receptacle 116.

The control system 175 then moves (step 444) the planar manipulator 102 to the new pad dispenser 118 and activates (step 446) the chucking mechanism to secure a new pad to the end effector 108. In both systems with and without pad lifting mechanisms, the upper surface of the end effector is placed against the lower surface of the pad. The control system 175 activates (step 448) the indexing mechanism in the new pad dispenser 118 to reposition the pads in the dispenser 118 and moves (step 450) the planar manipulator and the new pad toward the center platen. The controller then waits (step 452) for the pad to reach the platen, and when it does, the control system 175 deactivates (step 454) the chucking mechanism on the end effector and activates (step 456) the chucking mechanism on the platen. The planar manipulator then moves (step 458) again to the new pad dispenser 118, activates (step 460) the chucking mechanism to secure another new pad, and activates (step 462) the indexing mechanism in the new pad dispenser 118. The control system 175 then moves (step 464) the new pad toward the platen at polishing station 35*b* and waits (step 466) for the pad to reach the platen. When the pad reaches the platen, the controller deactivates (step 468) the chucking mechanism on the end effector and activates (step 470) the chucking mechanism on the platen. The planar manipulator 102 then returns (step 472) to its normal position, and the control system 175 instructs (step 474) the platen motors to begin the polishing process again.

While the pad changing mechanism 100 changes the pads at polishing stations 35*a* and 35*b*, the other pad changing mechanism (not shown) changes the pad at polishing station 35*c* in similar fashion, also under control of control system 175. The control system instead may be configured to replace each pad immediately after it is removed from the CMP apparatus and before the next pad is removed. The control system also may cause the planar manipulator to tilt the used pad immediately after it secures the pad to insure that slurry drips onto the baseplate of the CMP system and not onto other portions of the CMP apparatus.

Figure 7:
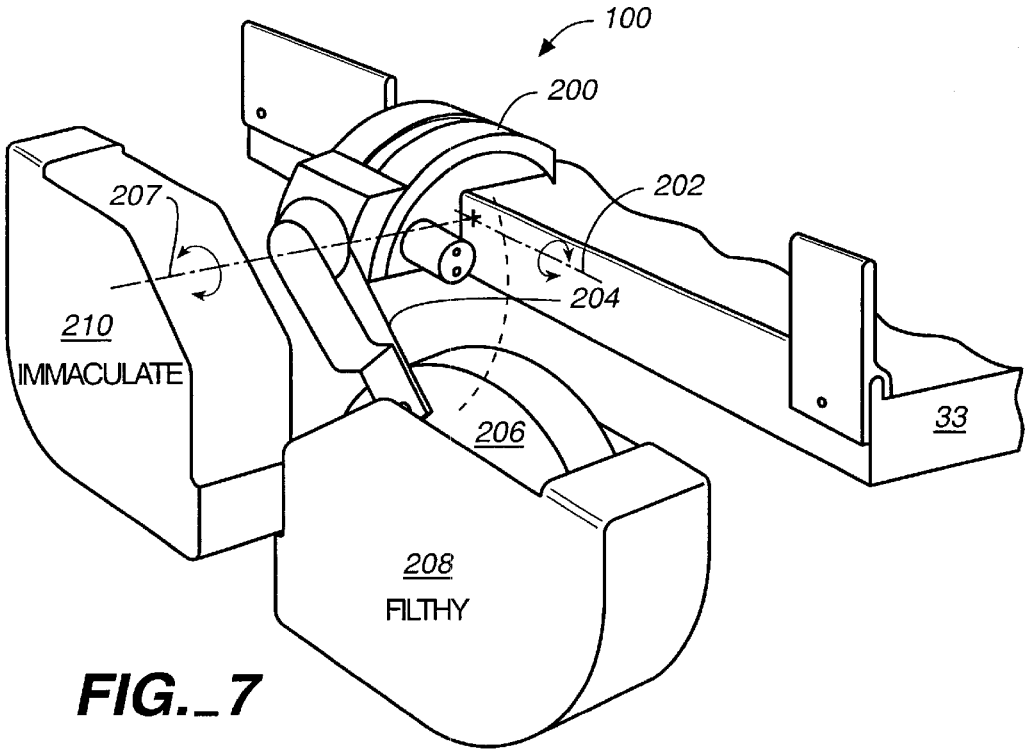
FIGS. 7 and 8 are partial perspective views of an alternative embodiment of an automatic pad changing mechanism.
Figure 8:
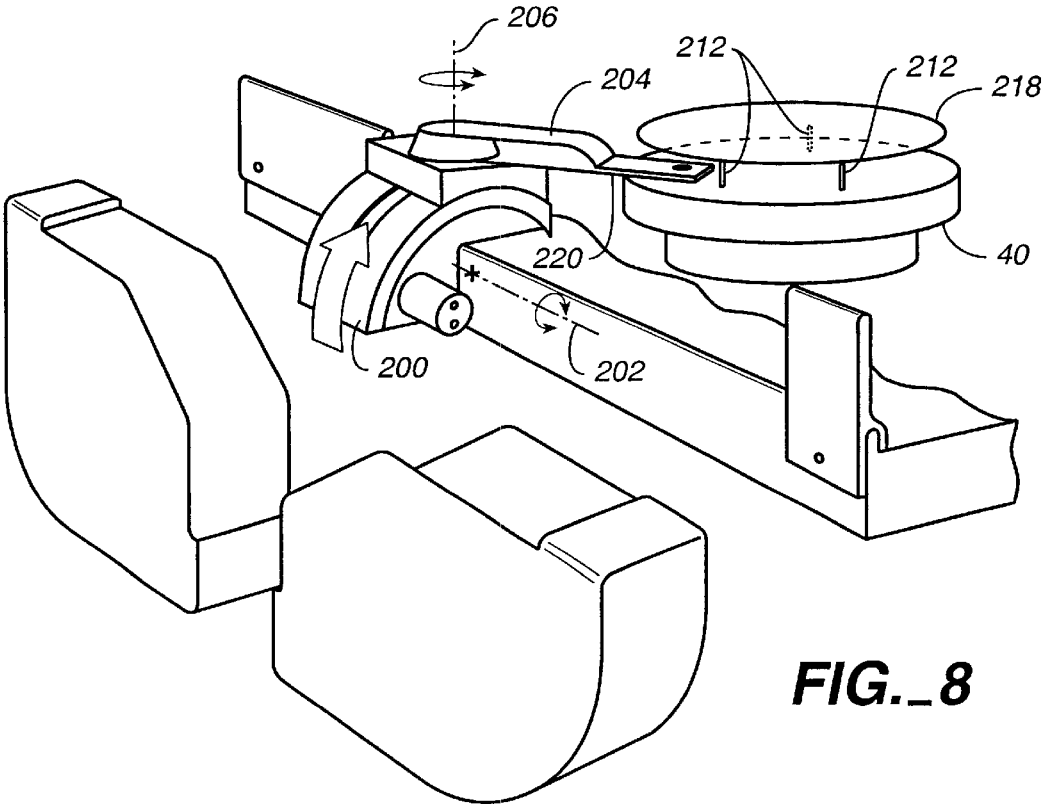

Referring to FIGS. 7 and 8, an alternative embodiment of the pad exchanging mechanism 100 is a rack-and-pinion mechanism 200 mounted to the table top 33 of the CMP apparatus. The rack-and-pinion mechanism 200 rotates about a horizontal axis 202 to move pads 206 between the polishing platen 40 and two indexing cassettes 208 and 210 mounted to the apparatus. A planar manipulator 204 connected to the rack-and-pinion mechanism 200 rotates about axis 207 to grip the pads 206 on the platen 40 and in the indexing cassettes 208 and 210. Three lifting mechanisms 212 in each platen 40 lift a used pad 218 from the platen 40 and then lower the pad 218 onto the planar manipulator 204 after the planar manipulator 204 has moved into place. The lifting mechanisms 212 preferably are pneumatically actuated, as described above. Also as discussed above, the planar manipulator 204 includes a standard Venturi blade end effector 220 that uses suction to secure the pad 218.

Figure 9:
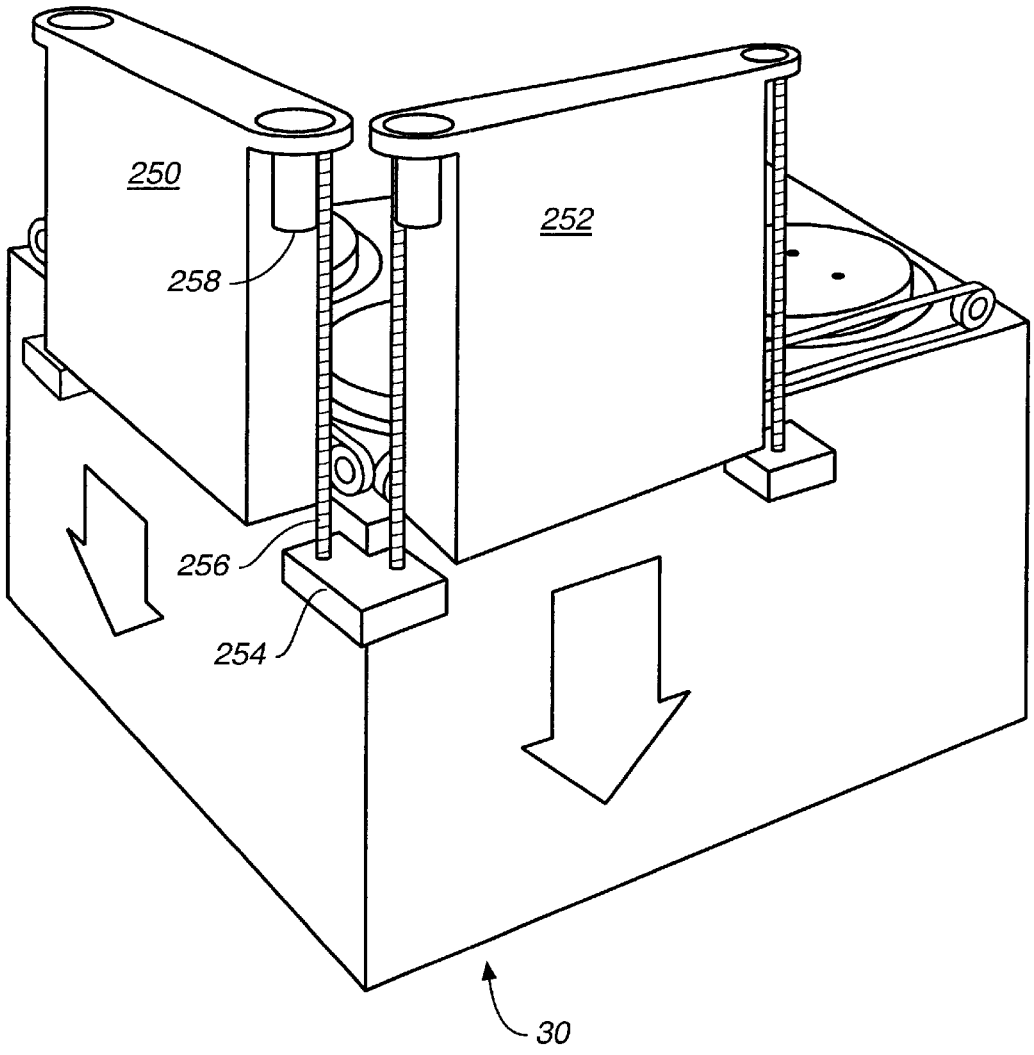
FIGS. 9, 10, and 11 are perspective views of an alternative embodiment of a chemical mechanical polishing apparatus with automatic pad changing capabilities.
Figure 10:
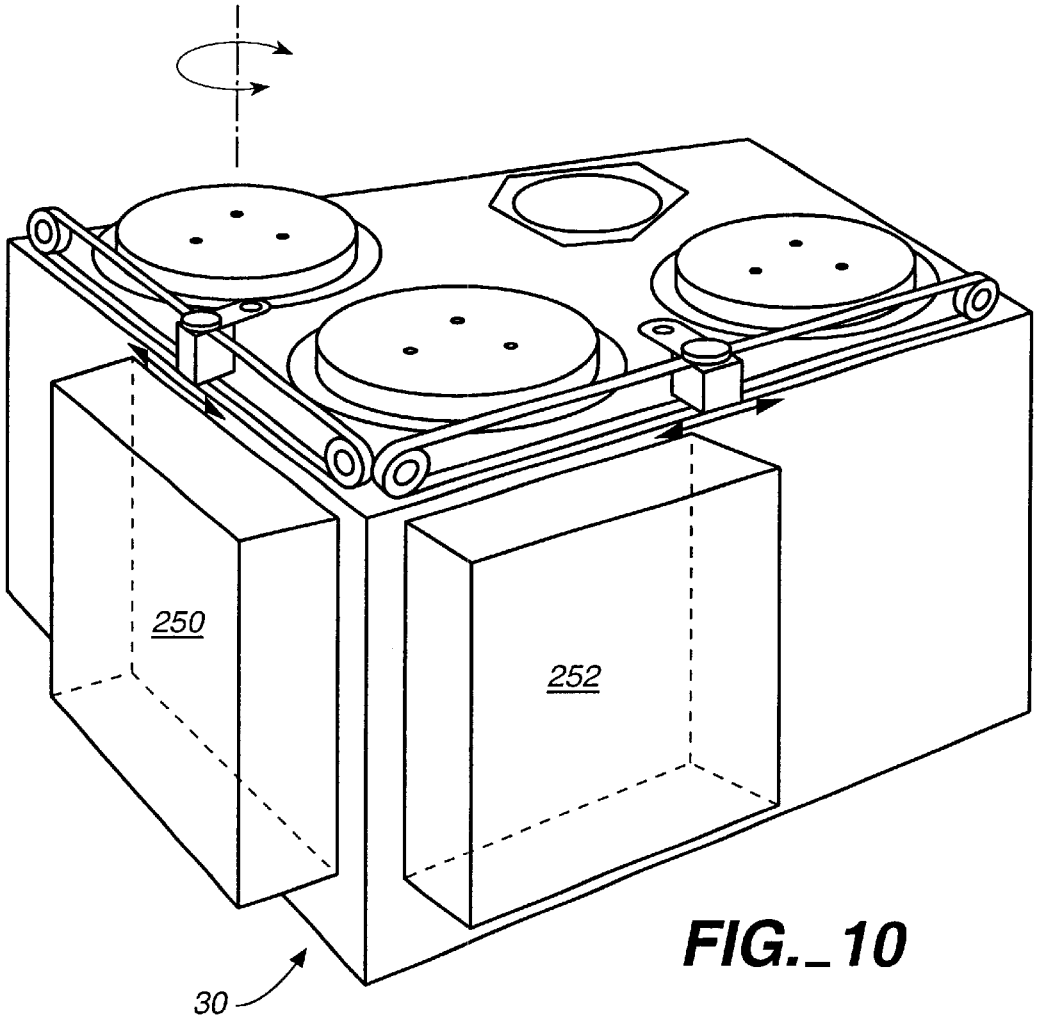

Referring to FIGS. 9 and 10, in an alternative embodiment, the CMP apparatus 30 includes two movable indexing cassettes 250 and 252 mounted to the CMP apparatus 30 by leadscrew and linear guide assemblies 254. The leadscrew 256 in each assembly is driven by a motor 258 mounted to the corresponding indexing cassette 250. The leadscrews 256 are fully extended (FIG. 9) to expose polishing pads in the cassettes when the polishing pads are being replaced, and are fully retracted (FIG. 10) during the polishing process.

Figure 11:
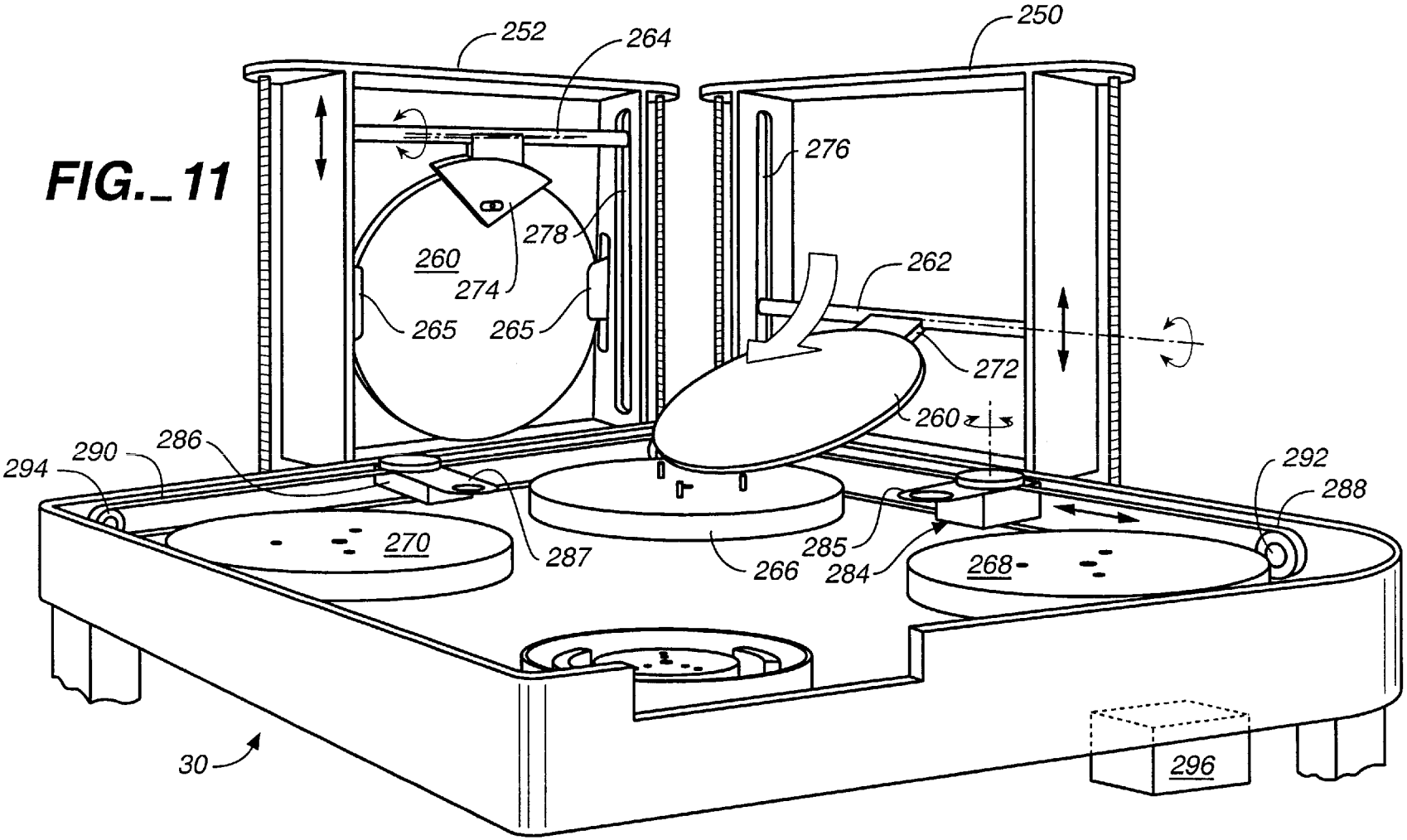

Referring also to FIG. 11, polishing pads 260 in the indexing cassettes 250 and 252 are placed onto a center platen 266 of the CMP apparatus 30 by "robots" 262 and 264 in the indexing cassettes 250 and 252, respectively. Each robot 262 and 264 includes an end effector 272 and 274, respectively, that uses suction to secure the pads 260 and carry them from the indexing cassettes 250 and 252 to the center platen 266. Each time a pad is removed from one of the cassettes, an indexing mechanism 265 in the cassette moves the next pad in the cassette forward to be placed on the center platen 266. Each robot 262 and 264 moves vertically in the corresponding indexing cassette 250 along a pair of linear tracks 276 and 278 (only one linear track is shown in each indexing cassette).

Figure 12C:
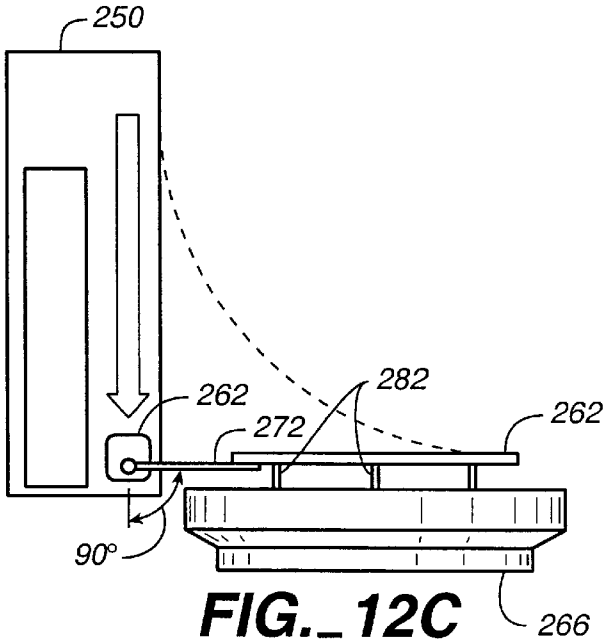
FIGS. 12A, 12B, and 12C are cross-sectional views of an alternative embodiment of an automatic pad changing mechanism.
Figure 12B:
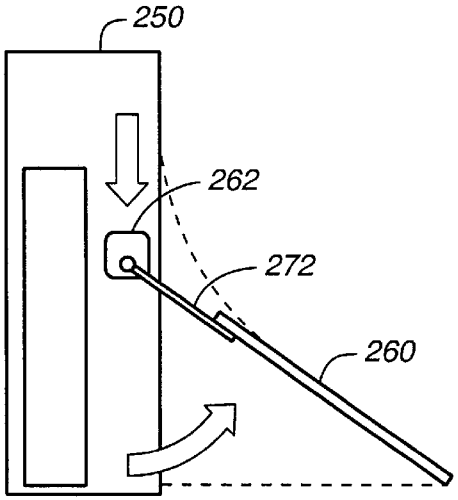
Figure 12A:
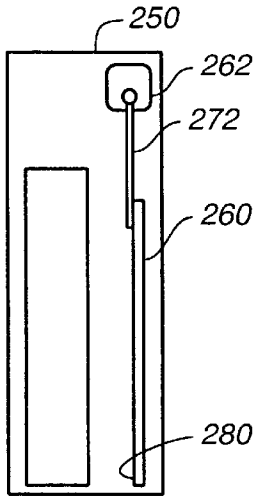

Referring also to FIGS. 12A, 12B, and 12C, the robot 262 in cassette 250 is positioned so that its end effector 272 contacts the rear surface 280 of the pad 260. Suction then is applied through the end effector 272, and the robot 262 moves down the linear track 276 toward the platen 266. At the same time, the end effector 272 begins to pivot upward by 90° so that the pad 260 is held adjacent and parallel to the center platen 266. The robot then lays the pad 260 onto several lift mechanisms 282 protruding from the platen 266, as discussed above, and retracts back into the indexing cassette 250. The pad 260 is affixed to the surface of the platen 266 by suction as the lifting mechanisms 282 retract into the platen 266.

Two additional robots 284 and 286 are mounted to the CMP apparatus by linear tracking mechanisms 288 and 290. Each of these robots 284 and 286 carries new polishing pads placed on the center platen 266 by robots 262 and 264 from the center platen 266 to the outer platens 268 and 270, respectively. These robots 284 and 286 also remove used pads from the platens 266, 268, and 270 and place them in used pad receptacles (not shown) adjacent the CMP apparatus 30. The linear tracking mechanisms 288 and 290 are driven by motors 292 and 294 controlled by an electronic controller 296. The robots 262 and 264 in the indexing cassettes also are driven by motors (not shown) controlled by the controller and are operated as discussed above. The robots 284 and 286 preferably include Venturi blade end effectors 285 and 287, respectively, that apply suction to the lower surface of the pads after the pads are lifted by pad lifting mechanisms 282.

Figures 13A, 13B, 13C:
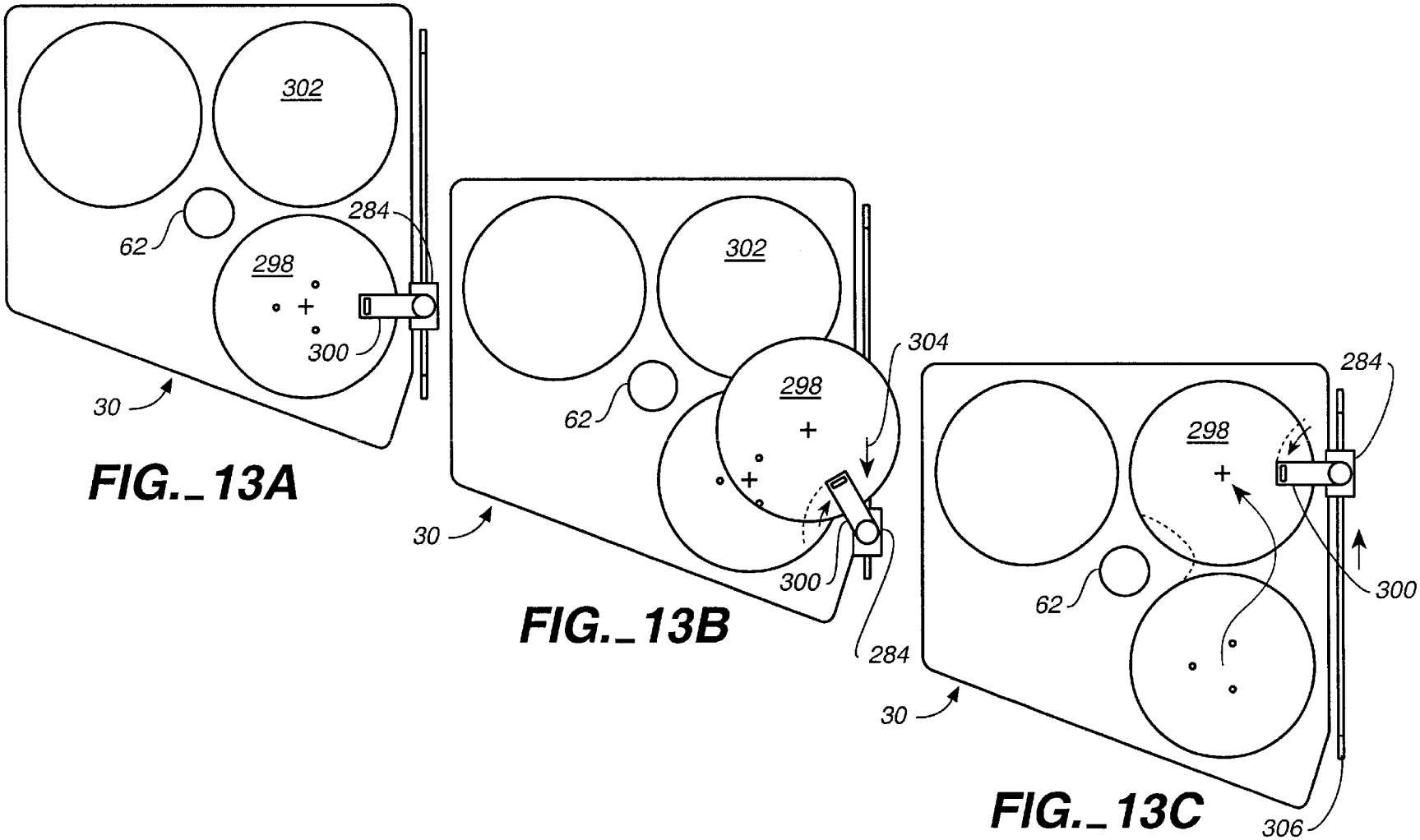
FIGS. 13A, 13B, and 13C are top views of a chemical polishing apparatus with automatic pad exchanging capabilities.

Referring to FIGS. 13A, 13B, and 13C, after robot 284 has secured a new or used polishing pad 298 to its end effector 300, the robot 284 must rotate clockwise and move linearly away from the destination platen 302 (i.e., in the direction of arrow 304) to insure that the pad 298 does not contact the center post 62 of the CMP apparatus 30. The robot 284 then moves linearly toward the destination platen 302 (i.e., in the direction of arrow 306) after the pad 298 has cleared the center post 62. As the robot 284 approaches the destination platen 302, the robot rotates counter-clockwise to position the pad 298 correctly over the platen 302. Robot 284 moves in this manner both to move new pads from center platen 302 to outer platen 298 and to move used pads from outer platen 298 to center platen 302. The other robot 286 of FIG. 11 must move in the same manner to avoid collisions between the pads and the center post 62.

The present invention has been described in terms of one or more preferred embodiments. The invention, however, is not limited to the embodiments depicted and described. Rather, the scope of the invention is defined by the following claims.

What is claimed is:

1. A chemical mechanical polishing apparatus, comprising:

a platen that can have a polishing pad affixed thereto in a first orientation;

a mechanical device having an effector to carry a polishing pad;

a pad receptacle to hold zero or more polishing pads, the pad receptacle holding each pad at a second orientation tilted relative to the first orientation and a controller operable to move the end effector so as to carry a polishing pad between the platen and the pad receptacle.

2. The apparatus of claim 1, wherein the pad receptacle holds used pads, and the controller operates to move the end effector and carry a used pad from the polishing pad to the pad receptacle.

3. The apparatus of claim 1, wherein the pad receptacle holds new pads, and the controller operates to move the end effector and carry a new pad from the pad receptacle to the platen.

4. The apparatus of claim 1, wherein the mechanical device includes a base rotatable about the first axis and an arm having a first segment and a second segment each having a first and a second end, wherein the first end of the first segment is pivotally attached to the base and the first end of the second segment is pivotally attached to the second end of the first segment so that the first segment is rotatable about a second axis substantially perpendicular to the first axis and the second segment is rotatable about a third axis substantially perpendicular to the first axis.

5. The apparatus of claim 1, wherein the pad receptacle includes an indexing mechanism to move the pads in the receptacle.

6. A chemical mechanical polishing apparatus comprising:

a polishing pad receptacle to hold a polishing pad in a first orientation;

a platen to hold the polishing pad in a second orientation tilted relative to the first orientation;

a mechanical device to carry the polishing pad between the platen and the pad receptacle, the mechanical device including a base rotatable about a first axis substantially parallel to a top surface of the platen and at least one arm segment pivotally attached to the base and rotatable about a second axis substantially perpendicular to the first axis.

7. The apparatus of claim 6, wherein the receptacle holds new pads, and the mechanical device carries the polishing pad from the receptacle to the platen.

8. The apparatus of claim 6, wherein the receptacle holds used pads, and the mechanical device carries the polishing pad from the platen to the receptacle.

9. A method of placing a new polishing pad on a platen in a chemical mechanical polishing system, comprising:

holding a polishing pad that has a top polishing surface and a bottom surface in a receptacle at a first orientation;

placing a vacuum chuck device against the polishing pad;

vacuum chucking the polishing pad to the device;

moving the device and the polishing pad to the platen;

releasing the polishing pad from the device to place it on the platen with the bottom surface of the polishing pad directly in contact with a top surface of the platen at a second orientation tilted relative to the first orientation; and vacuum chucking the polishing pad to the platen.

10. A chemical mechanical polishing apparatus comprising:

a first platen to hold a first polishing pad at a first orientation;

a second platen to hold a second polishing pad at a second orientation that is substantially parallel to the first orientation;

a pad receptacle to hold zero or more polishing pads, where each polishing pad is held at a pad receptacle orientation that is tilted relative to the first and second orientations;

a mechanical device movable between a first position adjacent the first platen, a second position adjacent the second platen, and a third position adjacent the pad receptacle;

a pad chucking mechanism connected to the mechanical device to hold a polishing pad; and a controller to operate the mechanical device and move the pad chucking mechanism between the first, second and third positions to carry polishing pads between the receptacle and the first and second platens.

11. The apparatus of claim 10, wherein each platen includes a pad chucking mechanism operable to vacuum affix the polishing pad to the platen.

12. The apparatus of claim 10, wherein the mechanical device includes a pad chucking mechanism operable to vacuum chuck the polishing pad to the mechanical device.

* * * * *